US005867920A

United States Patent [19]

Rogne et al.

[11] Patent Number: 5,867,920

[45] Date of Patent: Feb. 9, 1999

[54] HIGH SPEED INFRARED/CONVECTION DRYER

[75] Inventors: Allan W. Rogne, Two Rivers; Jeffrey D. Quass; Michael G. Tesar, both of Green Bay, all of Wis.

[73] Assignee: Megtec Systems, Inc., De Pere, Wis.

[21] Appl. No.: 796,009

[22] Filed: Feb. 5, 1997

[51] Int. Cl.[6] ..... F26B 3/34

[52] U.S. Cl. ..... 34/267; 34/268; 34/269; 34/633; 34/649

[58] Field of Search ..... 34/267, 268, 269, 34/420, 421, 444, 446, 447, 619, 629, 633, 641, 643, 649, 654

[56] References Cited

U.S. PATENT DOCUMENTS

| | | | |
|---|---|---|---|
| 3,643,342 | 2/1972 | Tyson et al. | 34/555 |
| 4,756,091 | 7/1988 | Van Denend | 34/4 |
| 4,918,828 | 4/1990 | Ruottu et al. | 34/4 |
| 4,936,025 | 6/1990 | Heikkila | 34/18 |
| 4,942,674 | 7/1990 | Karlsson | 34/18 |
| 4,952,145 | 8/1990 | Kwiatkowski et al. | 432/59 |
| 5,060,572 | 10/1991 | Waizmann | 101/424.1 |
| 5,092,059 | 3/1992 | Wimberger et al. | 34/156 |
| 5,261,166 | 11/1993 | Seeley et al. | 34/1 X |
| 5,440,821 | 8/1995 | Hamrin | 34/267 |

*Primary Examiner*—Henry A. Bennett
*Assistant Examiner*—Steve Gravini
*Attorney, Agent, or Firm*—Mitchell D. Bittman; Kevin S. Lemack

[57] ABSTRACT

A combination infrared/convection dryer or oven for drying travelling webs. A shutter assembly is provided between the infrared radiation source and the moving web in order to selectively expose the web to infrared radiation. Drying efficiency is optimized by adding heated impinged air at high velocity on the machine direction ends and between the infrared elements. The air being discharged on the web is heated as it is pulled across the elements to a centralized return air duct. The return air is pulled into the inlet of a close coupled supply fan which then discharges the air to the nozzles. A portion of the air is also exhausted to atmosphere to maintain the oven enclosure in a negative pressure state, thus drawing fresh make-up air into the oven housing through the web inlet and outlet slots. Flotation nozzles can be used where contactless support of the running web is desired. Enhanced drying of the web and/or a coating on the web at high speed is achieved without a concomitant increase in dryer length.

11 Claims, 5 Drawing Sheets

HIGH SPEED INFRARED/CONVECTION DRYER

BACKGROUND OF THE INVENTION

The present invention relates to web drying apparatus. In drying a moving web of material, such as paper, film or other sheet or planar material, it is often desirable that the web be dried quickly, and that the length of the dryer be limited in view of space and cost constraints. Various attempts have been made in the prior art for decreasing the length and/or increasing the efficiency and line speed of web dryers. To that end, infrared radiation has been used either alone or in combination with air to dry the web. For example, U.S. Pat. No. 4,936,025 discloses a method for drying a moving web by passing the web free of contact through various drying gaps. Thus, the web is passed through an infrared treatment gap in which infrared radiation is applied to the web from an infrared unit, and then is passed into an air-drying gap within which the web is dried by gas blowings from an airborne web dryer unit which simultaneously supports the web free of contact. Further, U.S. Pat. No. 4,756,091 discloses a hybrid gas-heated air and infrared radiation drying oven in which strips of infrared heaters are arranged with heated air inflow nozzles alongside thereof. U.S. Pat. No. 5,261,166 discloses a combination infrared and air flotation dryer wherein a plurality of air bars are mounted above and below the web for contactless convection drying of the web, and a plurality of infrared gas fired burners are mounted between air bars.

In many conventional infrared dryers, however, much of the heat supplied by the infrared energy source is lost to surroundings by transmission, reflection and radiation. In addition, the infrared elements must be continually turned on and off to avoid burning of the web. This reduces efficiency and can reduce infrared element life.

It is therefore an object of the present invention to provide a more efficient combination infrared/convection oven or dryer for drying moving webs.

It is a further object of the present invention to provide optimal control of an infrared/convection oven.

It is a still further object of the present invention to provide infrared and convection drying while floatingly supporting the moving web.

It is another object of the present invention to eliminate the need to continually turn the infrared elements on and off.

SUMMARY OF THE INVENTION

The problems of the prior art have been overcome by the present invention, which provides a combination infrared/convection dryer or oven for travelling webs. A shutter assembly is provided between the infrared radiation source and the moving web in order to selectively expose the web to infrared radiation. Drying efficiency is optimized by adding heated impinged air at high velocity on the machine direction ends and between the infrared elements. The air being discharged on the web is heated as it is pulled across the elements to a centralized return air duct. The return air is pulled into the inlet of a close coupled supply fan which then discharges the air to the nozzles. A portion of the air is also exhausted to atmosphere to maintain the oven enclosure in a negative pressure state, thus drawing fresh make-up air into the oven housing through the web inlet and outlet slots. Enhanced drying of the web and/or a coating on the web at high speed is achieved without a concomitant increase in dryer length.

In one embodiment of the invention, air bars are used to floatingly support the moving web to avoid contact of the web with dryer elements.

DETAILED DESCRIPTION OF THE INVENTION

Figure 1:
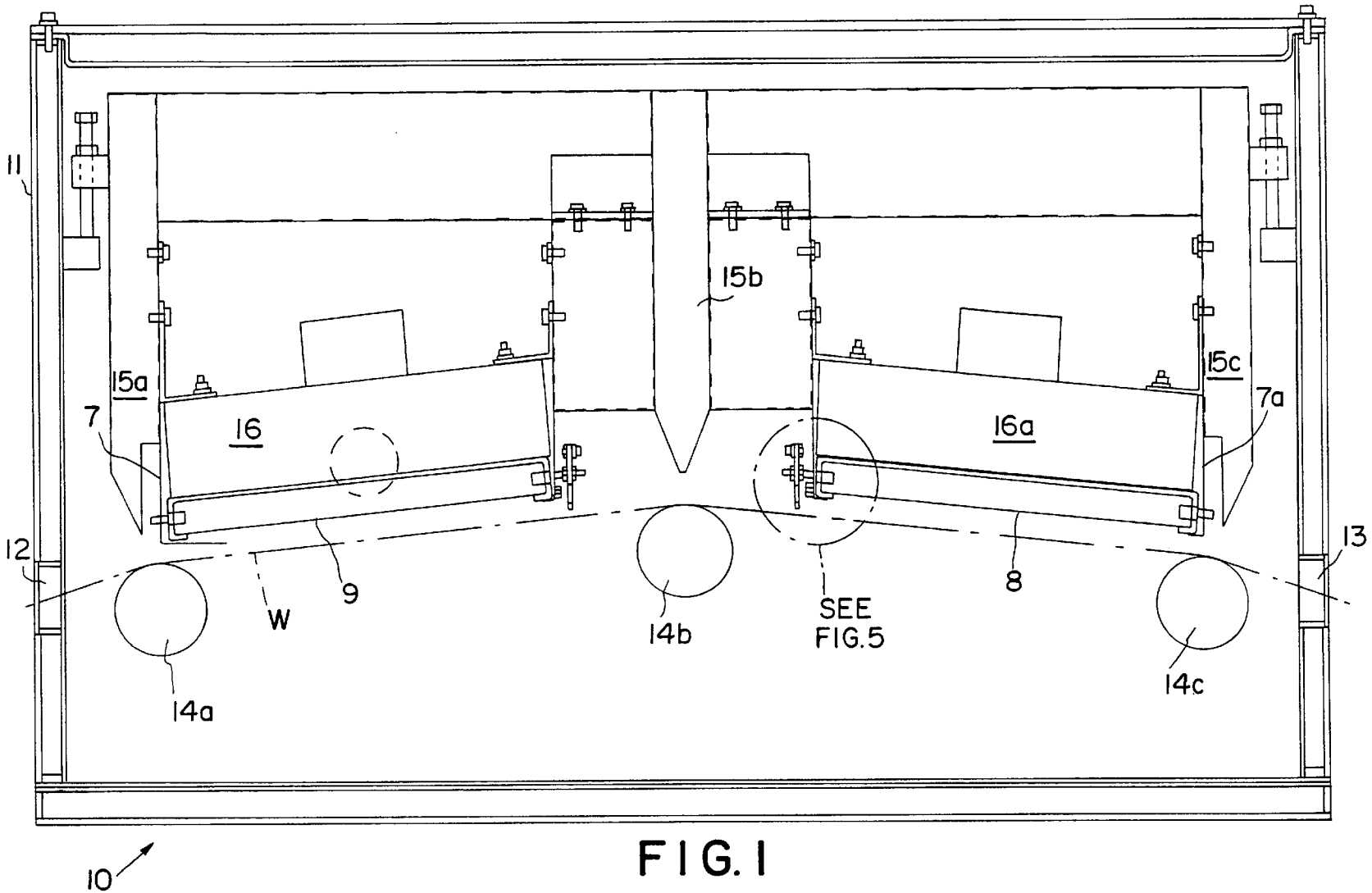
FIG. 1 is a front view of the infrared/convention oven in accordance with the present invention.

Turning first to FIG. 1, there is shown generally at 10 a dryer or oven in accordance with the present invention. The oven 10 is defined by a housing 11, preferably insulated, having a web inlet opening 12 to accommodate entry of a web W into the housing and a web outlet opening 13 spaced from the inlet 12 to accommodate exit of the web W from the housing, as shown. The housing 11 can be constructed of any suitable preferably reflective material, such as aluminum or stainless steel. A plurality of spaced idler rollers 14*a*–14*n* are provided to guide and support the web W as it travels through the oven 10 from the inlet 12 to the outlet 13. It is preferred that the rollers 14 be positioned at least below each source of impingement air 15*a*, 15*b* and 15*c* as shown, since at the points of impingement, the web W needs the most support to avoid web flutter, especially during low tension instances. A pair of infrared radiation elements 16, 16*a* are secured in the housing 11 to supplement the drying of the web.

Impingement air is preferably provided upstream and downstream of each infrared radiation source 16, 16*a*, which in the embodiment shown, is near the oven inlet 12, near the oven outlet 13, and in a central location in the oven. Air bars 15*a*, 15*b* and 15*c* are provided for this purpose, and are in communication with an air supply source, such as a fan, through suitable ductwork. The particular configurations of the air bars 15*a* and 15*c* are similar, and are designed to form air knives that provide mass transfer to the web and cooling air to the shutter assembly. The configuration of the central air bar 15*b* is designed to provide mass transfer to promote drying.

Positioned between air impingement sources 15*a* and 15*b* is elemental infrared radiation source 16. Toward the web inlet end the infrared radiation source 16 is mounted to the air impingement source 15*a* with L-shaped sheet 7, and is preferably angled upwardly towards the center of the oven as shown. This upward angle creates enough overwrap on the non-drive idler roller to create a driving force for the roller so that the web W proceeds properly through the oven. Similarly, positioned between air impingement sources 15*b* and 15*c* is a second infrared radiation source 16*a*, similarly mounted to the air impingement source 15*c* with L-shaped sheet 7*a*, and also angled upwardly towards the center of the oven 10 as shown.

Figure 2:
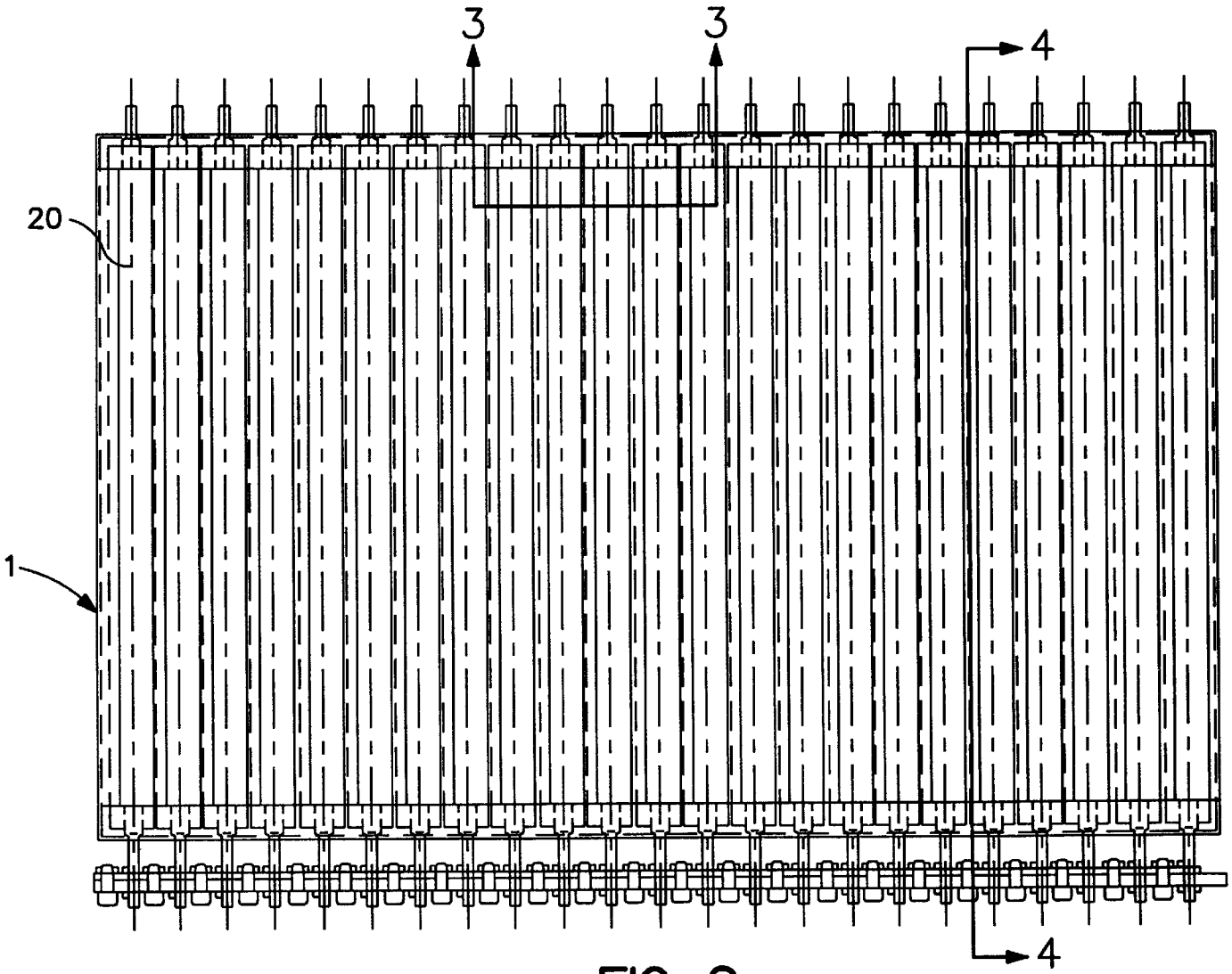
FIG. 2 is a top view of the shutter assembly for use in the dryer of the present invention.
Figure 3:
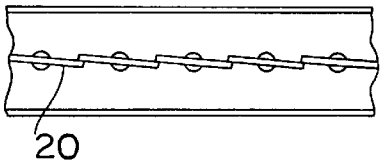
FIG. 3 is a front view of the shutter assembly taken along line 3–3 of FIG. 2.

Shutter assemblies 8 and 9 are positioned below infrared elements 16*a* and 16, respectively, to allow for control of the radiation permitted to reach the web W without the necessity of turning off the infrared radiation source(s). Referring to FIG. 2, each shutter assembly includes a plurality of aligned blades 20, each blade 20 slightly overlapping its adjacent blade when in the closed position, as best seen in FIG. 3. The number of blades 20 in each shutter assembly can vary, and depends on the particular dimensions of the infrared heating element being used. Although the dimensions of each blade are not critical, is has been found that blades 1 inch wide are suitable, and that such blades can be placed 0.94 inches center-to-center to create the necessary overlap. Preferably the damper blades 20 are designed with a reflecting surface to reflect the infrared light back towards the infrared elements and direct it way from the web.

Figure 4:
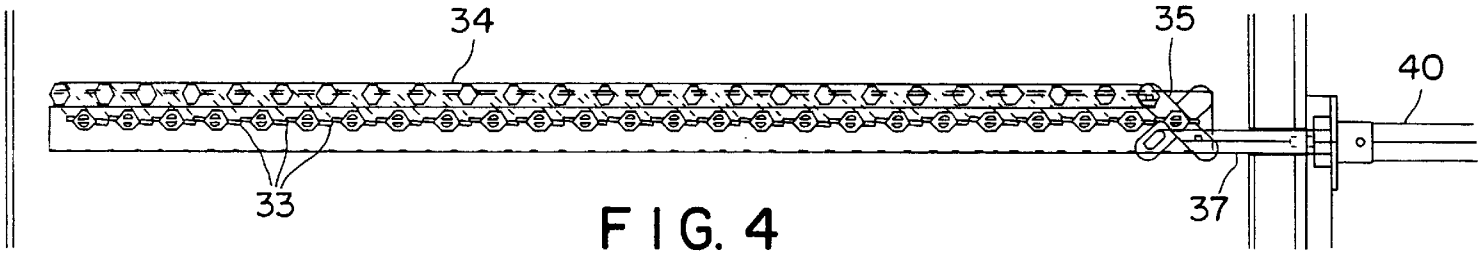
FIG. 4 is a side view of the shutter assembly, taken along line 4–4 of FIG. 2.
Figure 5:
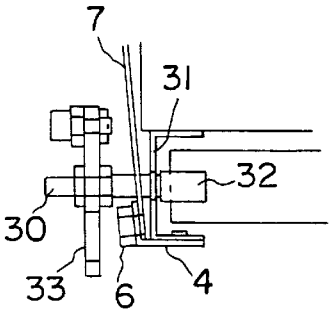
FIG. 5 is a detailed view showing the connection of a shutter to the control mechanism in accordance with the present invention.

Referring now to FIG. 5, the blades 20 are attached to the shutter assembly using a pin arrangement as shown. Thus, each end of each blade 20 is pivotally affixed to a clamp 32 on the end of pin 30. The end of pin 30 opposite clamp 32 is affixed to damper push link arm 33. Each push link arm 33 for each damper blade 20 is then connected via a connecting link 34 (FIG. 4), which allows all of the dampers to be pivoted upon actuation of an air cylinder 40 (located externally of the oven) which connects to a cylinder clevis 37 and then to the connecting link 34 via the damper link pivot 35.

Preferably the opening and closing of the shutters is based on line speed. At a predetermined line speed set point (which can be signaled by any suitable means, such as a magnetic pick-up connected to the coating line drive shaft), the shutters open and allow exposure of the web to the infrared radiation. In the event the line speed drops below the set point, the shutters close and prevent burning of the web.

Figure 6:
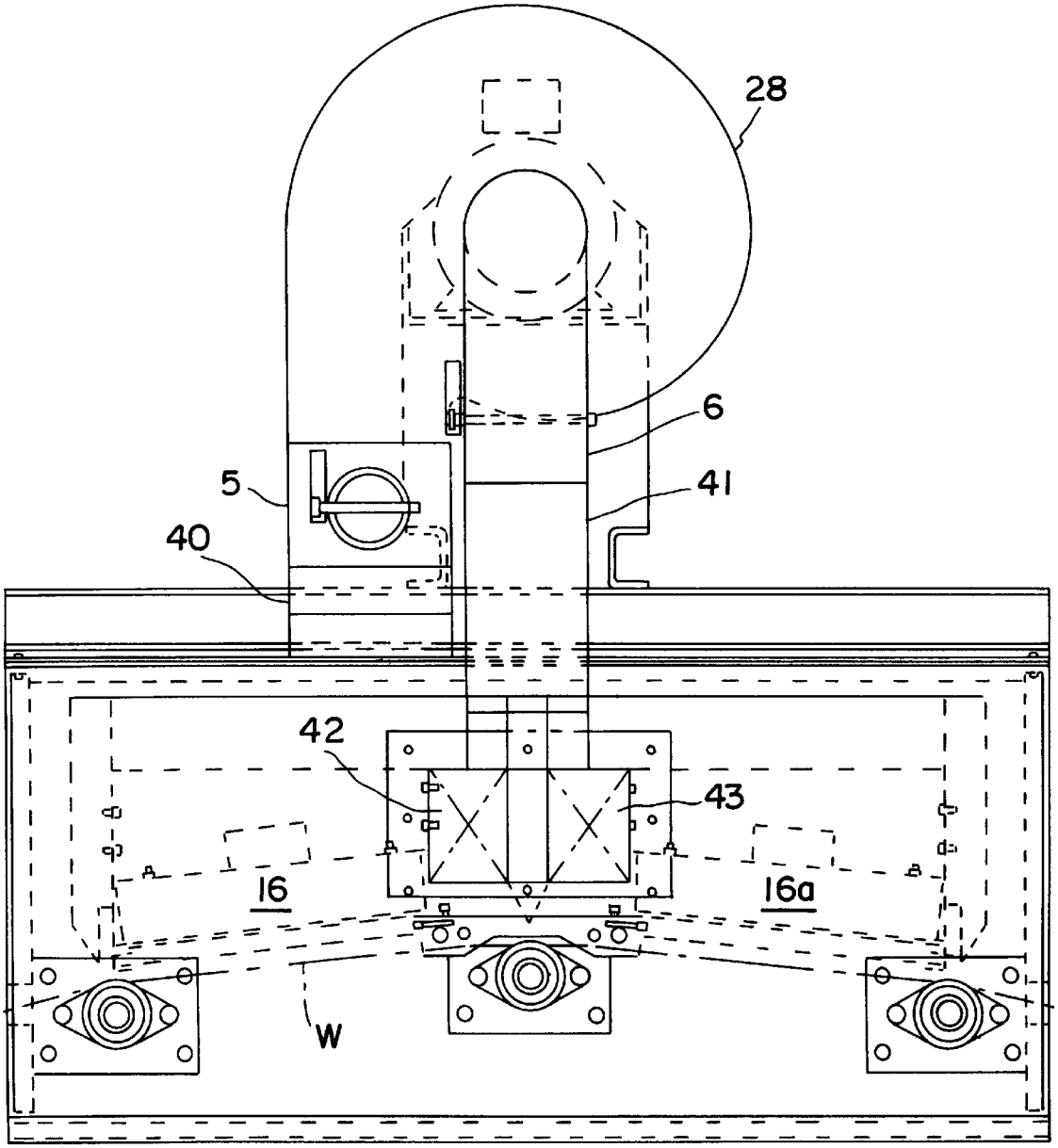
FIG. 6 is a front view of the oven with a close coupled fan assembly.

As shown in FIG. 6, a supply/exhaust fan 28 is in communication with the oven, and in particular, the air bars 15*a*, 15*b* and 15*c*, via suitable ductwork 40, 41. The fan 28 is sized to accommodate excess air that is exhausted in order to maintain the oven enclosure in a negative pressure state. This negative pressure causes infiltration air to enter into the oven 10 through the web inlet and outlet slots 12 and 13. Dampers 5 and 6 are provided in the ductwork to regulate the flow of air to and from the fan 28. Return air is pulled from the return ducts 42, 43 in the oven by the supply/exhaust fan 28. Since the return ducts are centrally located in the oven 10, the return air is directed over the entire face of the infrared heating element, thereby heating the recirculated supply air to improve efficiency.

Figure 7:
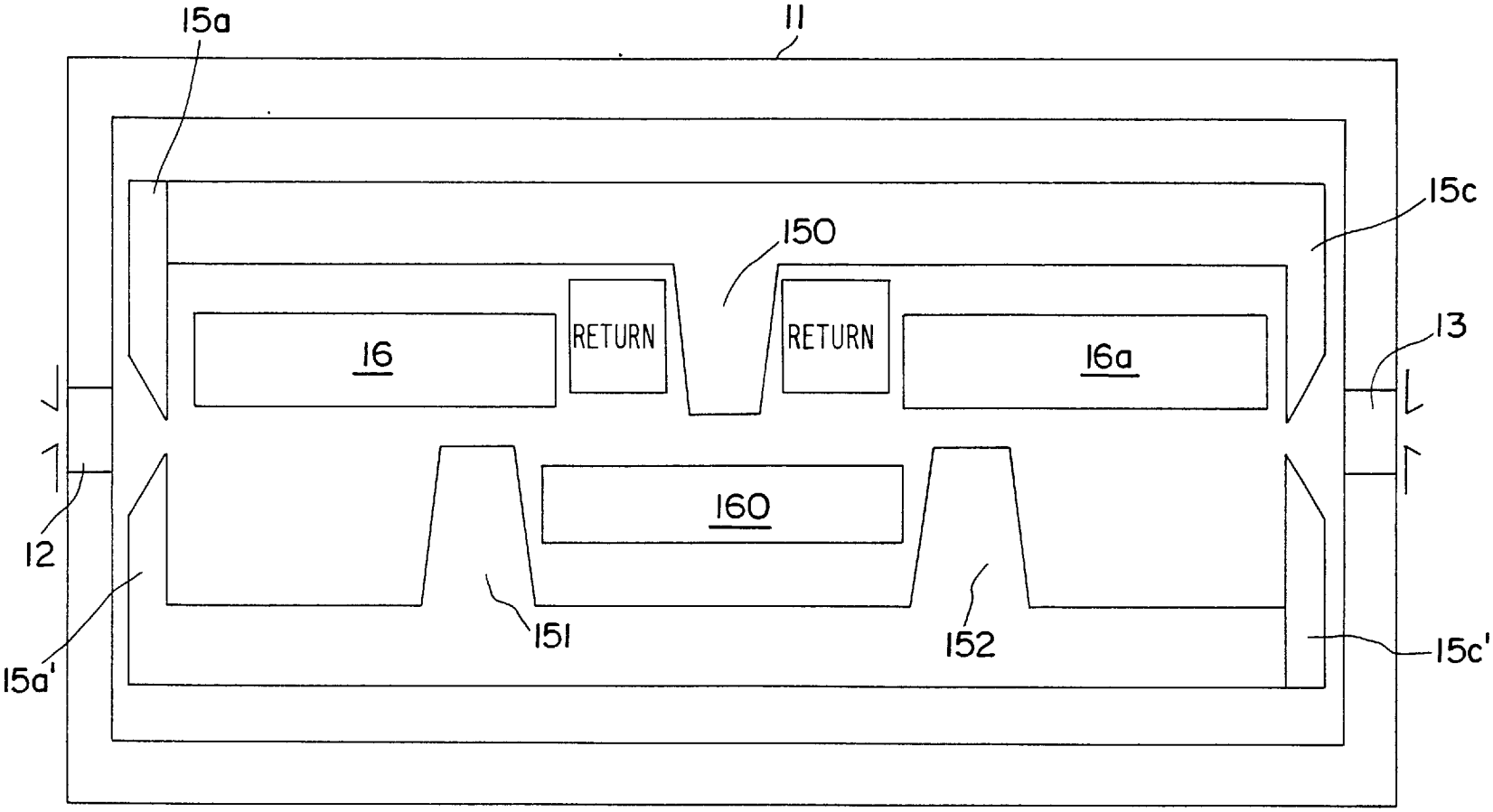
FIG. 7 is a schematic cross-sectional view of an infrared/convention floatation oven in accordance with an alternative embodiment of the present invention.

FIG. 7 shows an alternative embodiment of the present invention that employs flotation nozzles in place of the idler rollers in order to provide non-contact web support. Suitable flotation air bars include HI-FLOAT® air bars commercially available from Grace Tec Systems. In the embodiment shown, air knives 15*a* and 15*c* are positioned at the web entry and exit ends of the dryer in a manner similar to that in the previous embodiment, and provide mass transfer to the web and cooling air to the shutter assemblies as before. An air flotation nozzle 150 is preferably centrally located between air knives 15*a* and 15*b* . Similar air flotation nozzles 151 and 152 are positioned below the web between air knives 15*a*' and 15*c*', and are offset from air flotation nozzle 150. Air issuing from the air flotation nozzles supports and floatingly drys the running web. Elemental infrared radiation sources 16 and 16*a*, together with shutter assemblies (not shown) are positioned between each air knife and the flotation nozzle 150 above the web, analogous to the previous embodiment. Optionally, an infrared radiation source 160 and corresponding shutter assembly (not shown) can be located below the web and between flotation nozzles 151 and 152 to enhance drying efficiency.

Those skilled in the art will appreciate that the infrared radiation sources can be used above the web, below the web, or both, depending upon the drying capacity desired. Similarly, the particular location of the flotation nozzles will depend upon drying capacity, provided adequate web support is achieved.

An infrared pyrometer (not shown) is incorporated into the control scheme to maintain exit web temperature. Shutter open/close timing is based on the percent press speed. The shutter open/close control is also interlocked to a web break detector.

In operation, the supply/exhaust fan 28 is turned on, and a preheat cycle is begun by activating the shutter assembly to the closed position. The infrared element is turned on and a desired temperature set point is achieved, such as 1400° F. Once the set point is reached (which can be signaled by any suitable means, such as a light on a control panel), temperature is subsequently controlled via a thermocouple and SCR controller.

At the set point temperature, the oven is ready to dry. The shutter assembly is opened and closed via a line speed control set point, such as 70 feet per minute. Upon reaching the line speed set point, the shutters will open, thereby emitting the infrared energy to the web W media. Control of the element temperature will now shift to the web temperature via the web temperature infrared pyrometer and the SCR controller.

As the line speed is brought down to an intermittent stop, the shutter assembly will again be closed, once it decelerates past the line speed control set point. The infrared element temperature control will take over, maintaining the ready temperature set point. The same sequence occurs in the event of a web break.

Preferably a safety shutdown is incorporated that is based upon the infrared element temperature. For example, in the event the element temperature reaches 1800° F., a high temperature limit switch will actuate and shut off the element.

What is claimed is:

1. An infrared/convection dryer for a moving web, comprising:

a dryer enclosure having a web inlet slot and a web outlet slot spaced from said web inlet slot;

impingement means in said enclosure for causing gas to impinge upon said web;

a fan in communication with said impingement means for supplying said gas to said impingement means;

infrared heating means in said enclosure for irradiating infrared light and heating said web;

shutter means in said enclosure, said shutter means being moveable between a first open position allowing said irradiated infrared light to impinge upon said web and a second closed position preventing said irradiated infrared light from impinging upon said web; and recirculation means in communication with said fan for recirculating a portion of said gas from said dryer enclosure to said impingement means.

2. The infrared/convection dryer of claim 1, further comprising a return duct in said dryer enclosure for recirculating heated air to said fan and back into said enclosure.

3. The infrared/convection dryer of claim 1, wherein said impingement means comprises a plurality of air nozzles.

4. The infrared/convection dryer of claim 3, wherein said web is supported in said enclosure by a plurality of rollers, each positioned below an air nozzle.

5. The infrared/convection dryer of claim 1, wherein said impingement means comprises a plurality of flotation nozzles.

6. The infrared/convection dryer of claim 1, wherein the opening and closing of said shutter means is responsive to the speed of said moving web.

7. An infrared/convection dryer for drying a running web, comprising:

an dryer housing having a web inlet slot and a web outlet slot spaced from said web inlet slot;

impingement means in said housing for causing gas to impinge upon said web;

a fan in communication with said impingement means for supplying said gas to said impingement means;

infrared heating means in said housing for irradiating infrared light and heating said web;

means for measuring the speed of said running web;

shutter means in said housing responsive to said measured speed of said running web for selectively directing said infrared light away from said running web when said measured speed falls below a predetermined value; and recirculation means in communication with said fan for recirculating a portion of said gas from said dryer enclosure to said impingement means.

8. The infrared/convection dryer of claim 7, further comprising a return duct in said dryer housing for recirculating heated air to said fan and back into said housing.

9. The infrared/convection dryer of claim 7, wherein said impingement means comprises a plurality of air nozzles.

10. The infrared/convection dryer of claim 9, wherein said web is supported in said dryer by a plurality of rollers, each positioned below an air nozzle.

11. The infrared/convection dryer of claim 7, wherein said impingement means comprises a plurality of flotation nozzles.

* * * * *